United States Patent [19]

Dworman et al.

[11] Patent Number: 5,069,645

[45] **Date of Patent: * Dec. 3, 1991**

[54] COIN BANK

[75] Inventors: Ralph M. Dworman; Nancy S. Dworman, both of Worcester, Mass.

[73] Assignee: Ralphco, Inc., West Boylston, Mass.

[ * ] Notice: The portion of the term of this patent subsequent to Nov. 7, 2006 has been disclaimed.

[21] Appl. No.: 573,549

[22] Filed: Aug. 27, 1990

[51] Int. Cl.[5] ..... A45C 1/12; A63H 33/30

[52] U.S. Cl. ..... 446/8; 446/76; D99/37; D9/307; 206/457

[58] Field of Search ..... 446/8, 76, 71; D99/34–37; D9/307; 206/457; 232/4 R

[56] References Cited

U.S. PATENT DOCUMENTS

D. 117,935 12/1939 Prince ..... D99/35

D. 171,192 12/1953 Bower ..... D99/35

D. 285,139 8/1986 Miles ..... D99/35

4,878,867 11/1989 Dworman et al. ..... 446/8

*Primary Examiner*—Mickey Yu

*Attorney, Agent, or Firm*—Blodgett & Blodgett

[57] ABSTRACT

A coin bank having a cylindrical tubular intermediate portion, a base portion which is removably attached to the bottom of the intermediate portion and a hollow two-part cap portion which is removably attached to top of the intermediate portion. The two-part cap portion has a lower part which is attachable to the intermediate portion and an upper part which is attachable to the lower part in a snap fit. In a first embodiment of the invention, a coin slot is located in the lower part of the cap portion and in a second embodiment of the invention, a coin slot is located in the upper part of the cap portion.

5 Claims, 6 Drawing Sheets

FIG 1
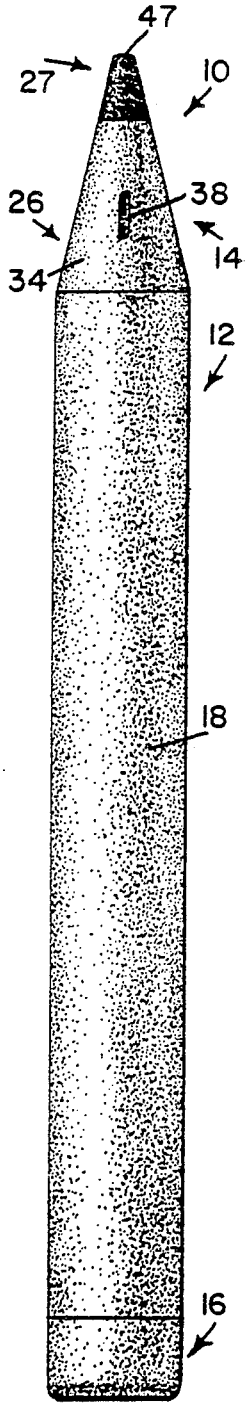
FIG. 2
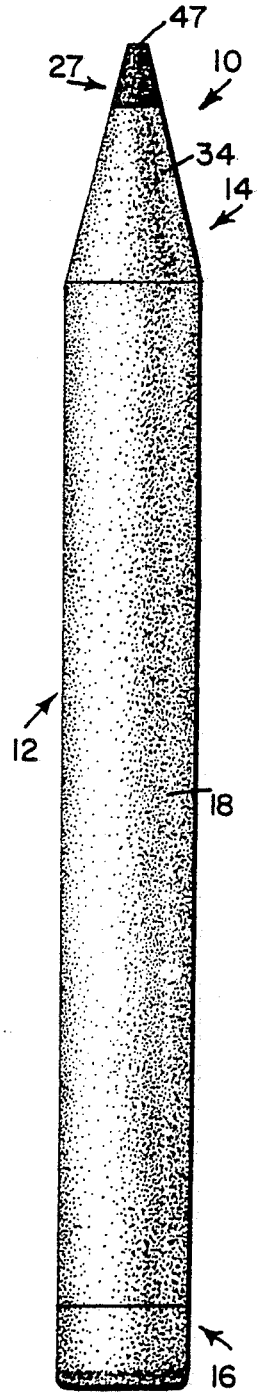
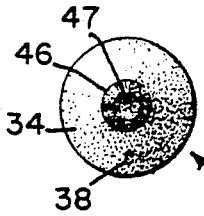
FIG. 3
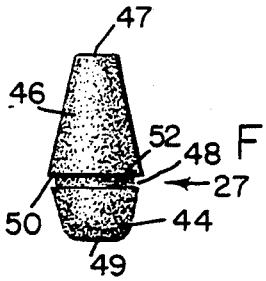
FIG. 5
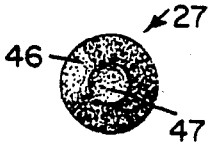
FIG. 6
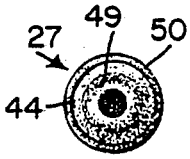
FIG. 7
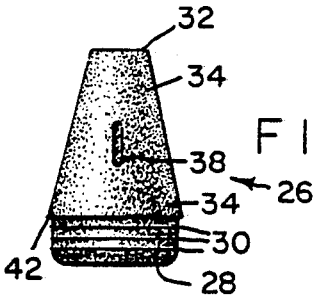
FIG. 8
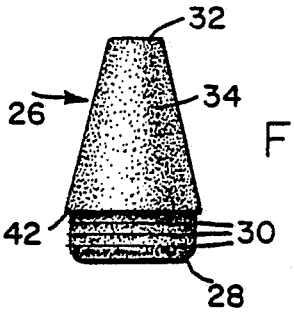
FIG. 9
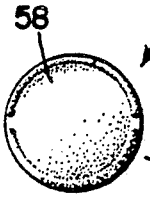
FIG. 4

FIG. 12
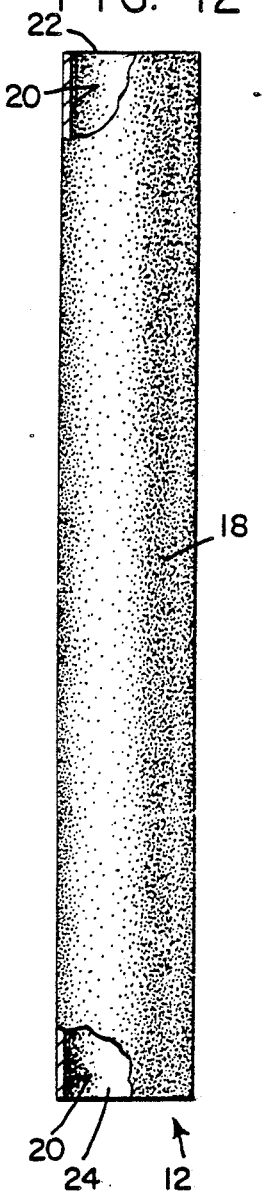
FIG. 14
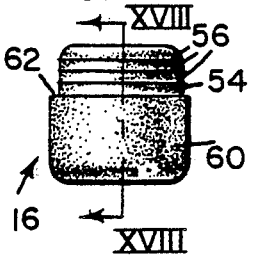
FIG. 15
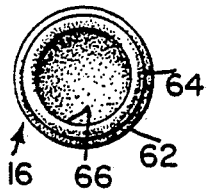
FIG. 16
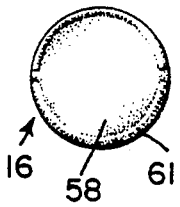
FIG. 10
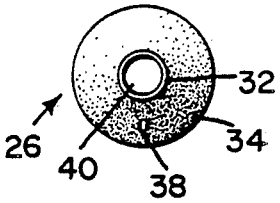
FIG. 11
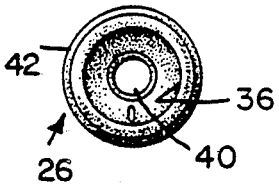
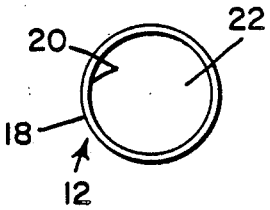
FIG. 13

FIG. 19
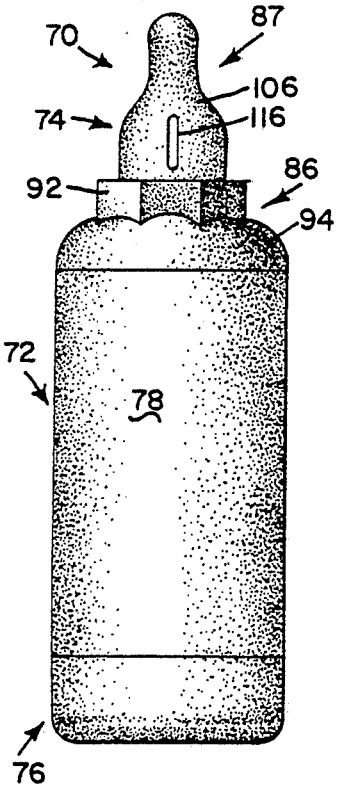
FIG. 20
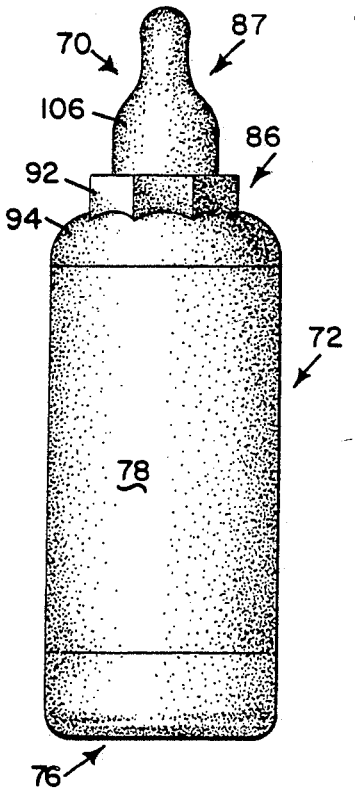
FIG. 21
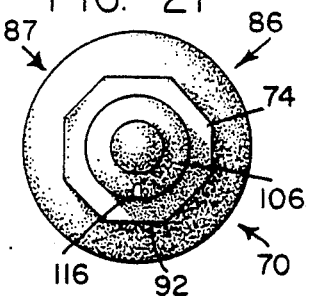
FIG. 22
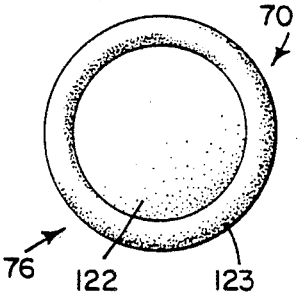
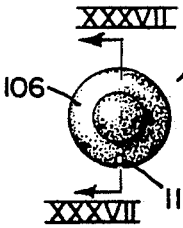
FIG. 25
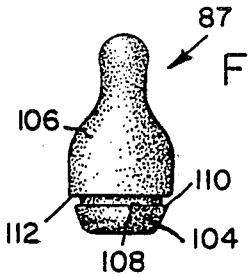
FIG. 24
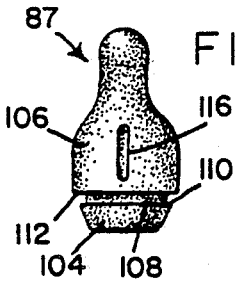
FIG. 23
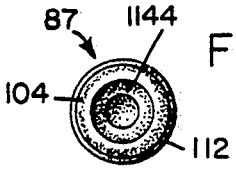
FIG. 26

FIG. 31
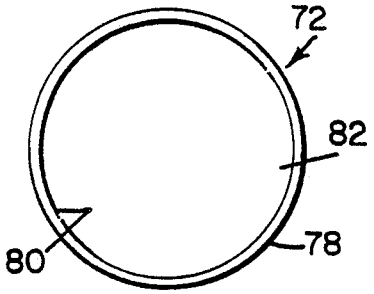
FIG. 28
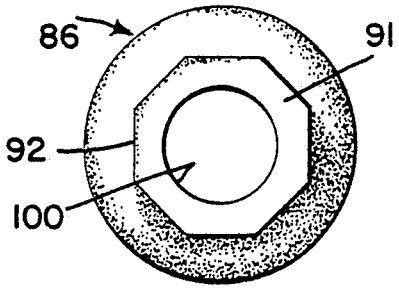
FIG. 30
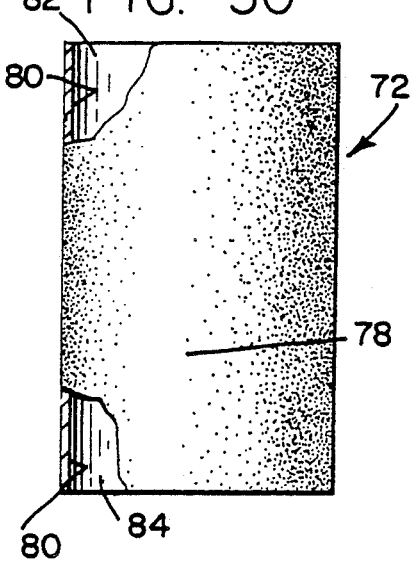
FIG. 27
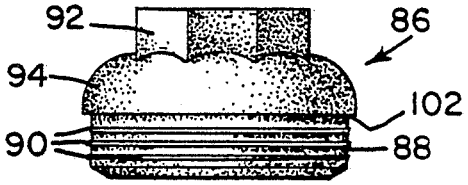
FIG. 29
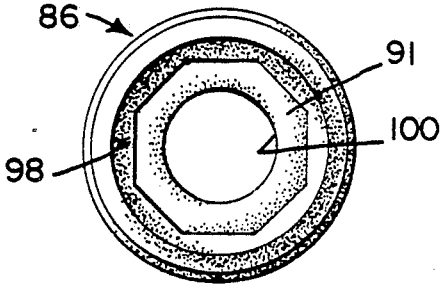
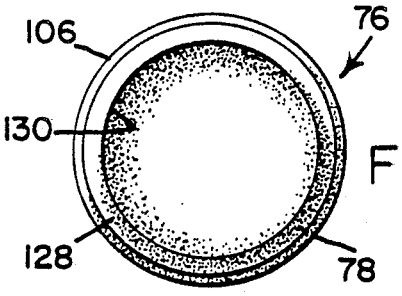
FIG. 33
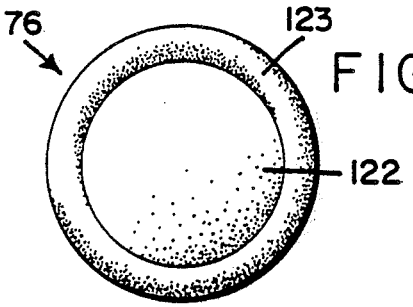
FIG. 34
FIG 32
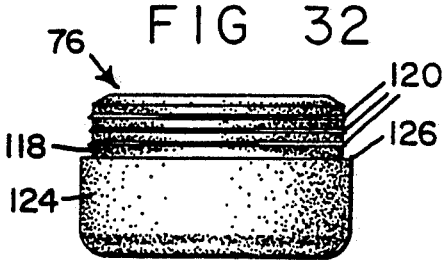

COIN BANK

BACKGROUND OF THE INVENTION

The present invention relates generally to a coin bank. Coin banks have been used for many years as a means for encouraging individuals, particularly children, to save. Coin banks are found in a wide variety of forms and shapes and typically includes a hollow housing which has a slot at the upper portion of the housing for receiving coins. Coin banks are very often in the form of a familiar object such as a pig. Most coin banks are designed to encourage saving and to discourage removal of the coins prematurely from the bank. For example, depositing of coins through the slot in the upper portion of the bank is relatively easy but very difficult, if not impossible, to remove coins through the slot from the interior of the bank. In some cases discouragement of for the removal of coins was taken to an extreme by making it necessary to break to remove the coins. On the other hand, if means are provided for creating easy access to the inside of the bank, there is a strong temptation to remove coins from the bank before the bank is full. These and other difficulties experienced with the prior art coin banks have been obviated by the present invention.

It is, therefore, a principle object of the invention to provide a coin bank in which coins can be removed from the bank if it becomes necessary to do so but with some difficulty to discourage premature or frequent withdrawal of coins from the bank.

Another object of the invention is the provision of a coin bank which comprises several portions which are assembled quickly and easily and are assembled with greater difficulty to maintain its integrity as a single unit at various stages of being filled with coins.

A further object of the present invention is the provision of a coin bank which effectively receives and holds coins and which has a familiar and pleasing shape to encourage children to utilize the bank for saving.

It is another object of the present invention to provide a coin bank which is simple in construction which is inexpensive to manufacture and easy to use.

With these and other objects in view, as will be apparent to those skilled in the art, the invention resides in the combination of parts set forth in the specification and covered by the claims appended hereto.

SUMMARY OF THE INVENTION

In general, the invention consists of a coin bank having a cylindrical tubular intermediate portion, a cap portion which fits into one end of the intermediate portion, and a base portion which fits into the opposite end of the intermediate portion. The cap portion has two parts: a lower part and an upper part. In one embodiment of the invention the lower part has a top surface with a hole in the top surface and an upper part which has a coin slot and a lower end which fits snugly in the aperture in the top surface fo the lower part. The lower part, in turn, fits snugly into the upper end of the cylindrical tubular intermediate portion. In a second embodiment of the invention, the lower part has a top surface with a hole in the top surface and a side surface which has a coin slot. The upper part fits snugly in the hole in the top surface of the lower part.

BRIEF DESCRIPTION OF THE DRAWINGS

The character of the invention, however, may be best understood by reference to one of its structural forms, as illustrated by the accompanying drawings, in which:

FIG. 1 is a front elevational view of a first embodiment of a coin bank embodying the principles of the present invention, FIG. 2 is a rear elevational view of the bank, FIG. 3 is a top plan view of the bank, FIG. 4 is a bottom plan view of the bank, FIG. 5 is a front elevational view of the upper part of the cap portion of the bank, FIG. 6 is a top plan view of the upper part of the cap portion, FIG. 7 is a bottom plan view of the upper part of the cap portion, FIG. 8 is a front elevational view of the lower part of the cap portion, FIG. 9 is a rear elevational view of the lower part of the cap portion, FIG. 10 is a top plan view of the lower part of the cap portion, FIG. 11 is a bottom plan view of the lower part of the cap portion, FIG. 12 is a front elevational view of the cylindrical intermediate portion of the bank, FIG. 13 is a top plan view of the intermediate portion, the bottom plan view of the intermediate portion being identical to that of the top plan view, FIG. 14 is a front elevational view of the base portion of the bank, FIG. 15 is a top plan view of the base portion, FIG. 16 is a bottom plan view of the base portion, FIG. 19 is a front elevational view of a second embodiment of a coin bank embodying the principles of the present invention, FIG. 20 is a rear elevational view of the second embodiment, FIG. 21 is a top plan view of the second embodiment, FIG. 22 is a bottom plan view of the second embodiment, FIG. 23 is a front elevational view of the upper portion of the cap portion of the second embodiment, FIG. 24 is a rear elevational view of the upper part of the cap portion of the second embodiment, FIG. 25 is a top plan view of the upper cap portion which is shown in FIG. 23, FIG. 26 is a bottom plan view of the upper part of the cap portion which is shown in FIG. 23, FIG. 27 is a front elevational view of the lower part of the cap portion of the second embodiment, FIG. 28 is a top plan view of the lower part of the cap portion which is shown in FIG. 27, FIG. 29 is a bottom plan view of the lower part of the cap portion which is shown in FIG. 27, FIG. 30 is a front elevational view of the cylindrical intermediate portion of the second embodiment, FIG. 31 is a top plan view of the intermediate portion of the second embodiment, the bottom plan view of the intermediate portion being identical to that of the top plan view, FIG. 32 is a front elevational view of the base portion of the second embodiment, FIG. 33 is a top plan view of the base portion of the second embodiment, FIG. 34 is a bottom plan view of the base portion of the second embodiment.

DESCRIPTION OF THE FIRST EMBODIMENT OF THE INVENTION

Figure 17:
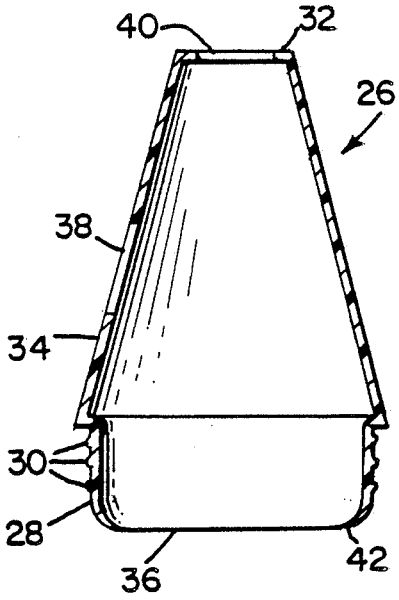
FIG. 17 is a vertical cross sectional view of the lower part of the cap portion of the bank taken along the line XVII—XVII of FIG. 8 and looking in the direction of the arrows.

Referring first to FIGS. 1–4, the first embodiment of the coin bank of the present invention is generally indicated by reference numeral 10 and comprises a cylindrical tubular intermediate portion which is generally indicated by the reference numeral 12, a cap portion which is generally indicated by the reference numeral 14, and a base portion which is generally indicated by the reference numeral 16.

Referring to FIGS. 1, 2, 12 and 13, the cylindrical tubular intermediate portion 12 has an outer cylindrical surface 18 and an inner cylindrical surface 20. The top of the tube 12 has a circular top opening 22. The bottom of the tube 12 has a circular bottom opening 24.

Referring particularly to FIGS. 6–11, the cap portion 14 consists of a lower part which is generally indicated by the reference numeral 26 and an upper part which is generally indicated by the reference numeral 27. The lower end of the lower part 26 has an outer cylindrical surface 28 which has a plurality of horizontal beads or ridges 30. The upper end of the lower part 26 has a top wall 32. A conical outer surface 34 tapers inwardly from a large diameter at its lower end to a small diameter at the top wall 32. The lower large diameter of the surface 34 is greater than the diameter of the cylindrical lower surface 28 and forms a shoulder 42 between the surface 34 and the surface 28. The bottom of the lower part 26 has a bottom opening 36. The conical surface 34 has a coin slot 38 and the top wall 32 has a circular hole 40 so that the top wall 32 is in the form of an inwardly facing annular flange about the hole 40.

The upper part 27 has a lower frusto-conical outer surface 44 and an upper frusto-conical outer surface 46. The surface 44 tapers inwardly in a downward direction and the surface 46 tapers inwardly in an upward direction. The upper part 27 has a bottom wall 49 and a top wall 47. The upper frusto-conical surface 46 extends between the top wall 47 and a bottom edge 50. The lower frusto-conical surface 44 extends from the bottom wall 49 to an upper edge 52. The surfaces 46 and 44 are separated by an annular groove 48 which is defined by the edges 50 and 52. The diameter of the edge 50 is substantially greater than the diameter of the hole 40 and the diameter of the edge 52 is only slightly larger than the diameter of the hole 40. The diameter of the groove 48 is slightly less than the diameter of the hole 40. The lower part 26 is made of a resilient flexible material such as plastic which enables the lower portion of the upper part 27 to be forced into the hole 40 so that inner edge of the flange shaped wall 32 extends into the groove 48 in a snap fit. The upper part 27 can be removed from the lower part 26 but not very easily. The lower edge 50 has the same diameter as the upper end of the lower part 26 so that when the parts 26 and 27 are coupled, the frusto-conical surfaces 34 and 46 of the parts 26 and 27, respectively, are continuous as shown in FIGS. 1 and 2.

Figure 18:
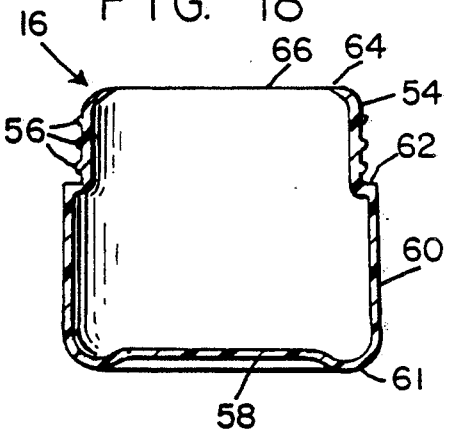
FIG. 18 is a vertical cross sectional view of the base portion of the bank taken along the line XVIII—XVIII of FIG. 14 and looking in the direction of the arrows.

Referring to FIGS. 1, 2, 14–16 and 18, the base 16 includes a cylindrical upper end which has a vertical cylindrical outer surface 54. A plurality of spaced annular horizontal beads or ridges 56 extend from the surface 54. The lower part of the base portion 16 includes a bottom wall 58 and a vertical cylindrical outer surface 60 which has the same diameter as the outer surface 18 of the tubular intermediate portion 12. The center portion of the bottom wall 58 is recessed slightly to form an annular outer bead 61. The bead 61 helps to stabilize the bank 10 in the upright position as shown in FIG. 1. The diameter of the cylindrical surface 54 is substantially less than the surface 60 so that an annular shoulder 62 is formed between the surfaces 60 and 54. The base of the cap has a top wall 64 which has the shape of an inwardly directed annular flange 64. The inner edge of the flange 64 defines a circular top opening 66. The cylindrical upper end of the base which is defined by the surface 54 fits snugly within the opening 24 of the tubular intermediate portion 12. When the cylindrical upper end of the base is inserted into the bottom opening 24 of the intermediate portion 12 so that the shoulder 62 abuts the bottom edge of the portion 12, the cylindrical surface 60 is continuous with the outer surface 18 of the intermediate portion 12 as shown in FIGS. 1 and 2. The ridges 56 are relatively slight but create sufficient frictional resistance to sliding so that when the base portion 16 is attached to the intermediate portion 12 by inserting the cylindrical upper end of the base portion into the bottom opening 24 of the intermediate portion 12, the portions 12 and 16 remain attached through normal handling of the coin bank 10. However, the base portion 16 can be removed from the intermediate portion 12 when it becomes necessary to do so. The various portions of the bank can be made of any relatively rigid material. However, it is preferred that the cap portion 14 and the base portion 16 be formed of a plastic material while the intermediate portion 12 is formed of a rigid cardboard material. The portions 12, 14, and 16 are formed separately and assembled to form the coin bank 10 by inserting the cylindrical lower end of the lower part 26 of the cap into the opening 22 until the shoulder 42 meets the top edge of the intermediate portion 12. The upper part 27 of the cap is snapped into the lower part 26. The base portion 16 is attached to the intermediate portion 12 by inserting the cylindrical upper end of the cap portion into the bottom opening 24 of the intermediate portion until the shoulder 62 meets the bottom edge of the intermediate portion. Once assembled, the portions 12, 14 and 16 remain intact through normal use of the coin bank due to the snug fit of the cap and base portions 14 and 16, respectively, to the intermediate portion 12. The bank 10 is used by standing the bank 10 in the upright position shown in FIGS. 1 and 2 with the outer bead bottom wall 61 resting on a flat supporting surface. Coins are inserted into the bank through the slot 38. The coins fall through the bottom opening 36 of the cap portion 14, through the intermediate portion 12, through the top opening 66 of the base portion 16 to the bottom wall 58. As additional coins are added to the bank, the bank becomes more stable due to the increasing weight of the coins put in the bank. When the coin bank 10 is filled with coins or the coins which are deposited therein reach a predetermined level in the bank, the coins can be removed from the bank by removing the cap portion 14 or the base portion 16 from the intermediate portion 12 to expose one end opening of the intermediate portion so that coins within the bank can be poured out of the bank and collected.

DESCRIPTION OF THE SECOND EMBODIMENT OF THE INVENTION

Referring first to FIGS. 19–22, the second embodiment of the coin bank of the present invention is generally indicated by reference numeral 70 and comprises a cylindrical tubular intermediate portion which is generally indicated by the reference numeral 72, a cap portion which is generally indicated by the reference numeral 74, and a base portion which is generally indicated by the reference numeral 76.

Referring to FIGS. 19, 20, 30, and 31, the cylindrical tubular intermediate portion 72 has an outer cylindrical surface 78 and an inner cylindrical surface 80. The top of the tube 72 has a circular top opening 82. The bottom of the tube 72 has a circular bottom opening 84.

Figure 35:
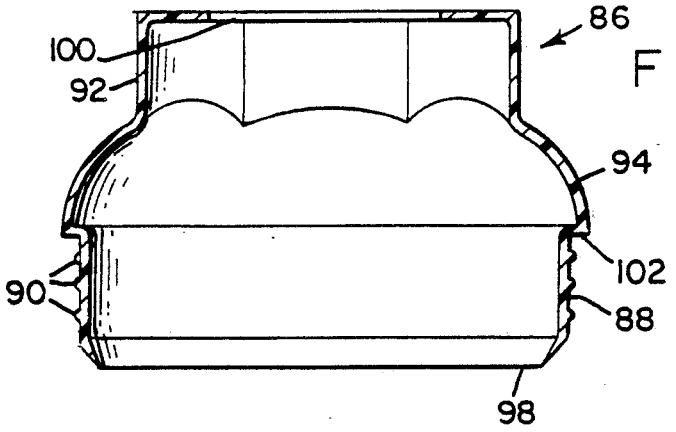
FIG. 35 is a vertical cross sectional view of the lower part of the cap portion of the second embodiment taken along the line XXXV—XXXV of FIG. 27 and looking in the direction of the arrows.
Figure 37:
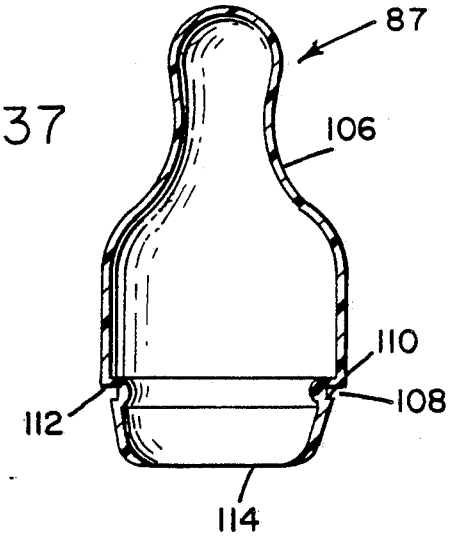
FIG. 37 is a vertical cross sectional view of the portion of the upper part of the cap portion of the second embodiment taken along the lines XXXVII—XXXVII of FIG. 25 and looking in the direction of the arrows.

Referring particularly to FIGS. 23–29, 35 and 37, the cap portion 74 consists of a lower part which is generally indicated by the reference numeral 86 and an upper part which is generally indicated by the reference numeral 87. The lower end of the lower part 86 has an outer cylindrical surface 88 which has a plurality of horizontal beads or ridges 90. The upper end of the lower part 86 has a top wall 91. The upper end of the lower part 86 also has a vertical octagonal surface 94 below the top wall 91 and a rounded convex surface 94 between the surface 92 and the surface 88. The lower edge of the surface 94 forms a circular shoulder 102 which has a greater diameter than the surface 88. The bottom of the lower part 86 has a bottom opening 98. The top wall 91 has a circular hole 100 so that the top wall 91 is in the form of an inwardly facing annular flange about the hole 100.

The upper part 87 has a lower frusto-conical outer surface 104 and an upper nipple shaped outer surface 106. The surface 104 tapers inwardly in a downward direction from an upper circular edge 110. The upper part 87 has a circular bottom opening 114. The nipple shaped surface 106 extends upwardly from a circular lower edge 112. The edges 112 and 110 are separated by an annular groove 108. The diameter of the edge 112 is substantially greater than the diameter of the hole 100 and the diameter of the edge 110 is only slightly larger than the diameter of the hole 100. The diameter of the groove 108 is slightly less than the diameter of the hole 100. The lower part 86 is made of a resilient flexible material such as plastic which enables the lower portion of the upper part 87 to be forced into the hole 100 so that inner edge of the flange shaped wall 91 extends into the groove 108 in a snap fit. The upper part 87 can be removed from the lower part 86 but not very easily.

Figure 36:
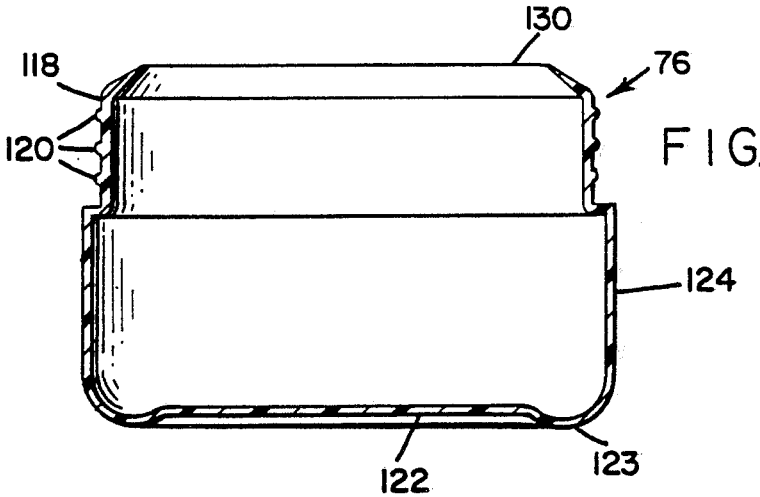
FIG. 36 is a vertical cross sectional view of the base portion of the second embodiment taken along the lines XXXVI—XXXVI of FIG. 32 and looking in the direction of the arrows.

Referring to FIGS. 19, 20, 32–34, and 36, the base 76 includes a cylindrical upper end which has a vertical cylindrical outer surface 118. A plurality of spaced annular horizontal beads or ridges 126 extend from the surface 118. The lower part of the base portion 76 includes a bottom wall 122 and a vertical cylindrical outer surface 124 which has the same diameter as the outer surface 78 of the tubular intermediate portion 72. The center portion of the bottom wall 122 is recessed slightly to form an annular outer bead 123. The bead 123 helps to stabilize the bank 70 in the upright position as shown in FIG. 19. The diameter of the cylindrical surface 118 is substantially less than the surface 124 so that an annular shoulder 126 is formed between the surfaces 124 and 118. The base 76 has a top wall which in the form of an inwardly directed annular flange 128. The inner edge of the flange 128 defines a circular top opening 130. The cylindrical upper end of the base which is defined by the surface 118 fits snugly within the opening 84 of the tubular intermediate portion 72. When the cylindrical upper end of the base is inserted into the bottom opening 84 of the intermediate portion 72 so that the shoulder 126 abuts the bottom edge of the portion 72, the cylindrical surface 124 is continuous with the outer surface 78 of the intermediate portion 72 as shown in FIGS. 19 and 20. The ridges 120 are relatively small but create sufficient frictional resistance to sliding so that when the base portion 76 is attached to the intermediate portion 72 by inserting the cylindrical upper end of the base portion into the bottom opening 84 of the intermediate portion 72, the portions 72 and 76 remain attached through normal hendling of the coin bank 70. However, the base portion 76 can be removed from the intermediate portion 72 when it becomes necessary to do so. The various portions of the bank can be made of any relatively rigid material. However, it is preferred that the cap portion 87 and the base portion 76 be formed of a plastic material while the intermediate portion 72 is formed of a rigid cardboard material. The portions 72, 74, and 76 are formed separately and assembled to form the coin bank 72 by inserting the cylindrical lower end of the lower part 86 of the cap into the opening 82 until the shoulder 102 meets the top edge of the intermediate portion 72. The upper part 87 of the cap is snapped into the lower part 86. The base portion 76 is attached to the intermediate portion 72 by inserting the cylindrical upper end of the cap portion into the bottom opening 84 of the intermediate portion until the shoulder 126 meets the bottom edge of the intermediate portion. Once assembled, the portions 72, 74, and 76 remain intact through normal use of the coin bank due to the snug fit of the cap and base portions 74 and 76, respectively, to the intermediate portion 72. The bank 70 is used by standing the bank in the upright position shown in FIGS. 19 and 20 with the outer bead 123 resting on a flat supporting surface. Coins are inserted into the bank through the slot 116. The coins fall through the bottom opening 114 of the upper cap portion 87, through the bottom opening 98 of the lower part 86, through the intermediate portion 72, and through the top opening 130 of the base portion 76 to the bottom wall 122. As additional coins are added to the bank, the bank becomes more stable due to the increasing weight of the coins put in the bank. When the coin bank 70 is filled with coins or the coins which are deposited therein reach a predetermined level in the bank, the coins can be removed from the bank by removing the cap portion 74 or the base portion 76 from the intermediate portion 72 to expose one end opening of the intermediate portion so that coins within the bank can be poured out of the bank and collected.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A coin bank comprising:

(a) a cylindrical tubular intermediate portion which has a vertical central longitudinal axis, a circular inner surface, a circular outer surface, a top end with a top opening, and a bottom end with a bottom opening, (b) a base portion which has a bottom wall and a cylindrical upper end which is removably attached to the bottom end of said intermediate portion, said cylindrical upper end having a top opening, (c) a two-part cap portion which has an outer wall which defines a hollow interior and a coin slot in said outer wall, the interior of said two-part portion being open to the interior of said intermediate portion below said coin slot, said two-part cap portion comprising:

(1) a lower part which has a top wall, a hole in said top wall, a cylindrical lower end which fits snugly within the top opening of said intermediate portion so that said lower part is removably attached to the top end of said intermediate portion, (2) an upper part which has an annular lower edge which is substantially larger than the hole in said top wall and a reduced bottom portion which fits snugly within the hole in said top wall so that said lower edge rests on said top wall when said reduced portion is fully inserted into said hole.

2. A coin bank as recited in claim 1, wherein said coin slot is in said upper part above said lower edge and said upper part has a hole at the bottom of said reduced portion.

3. A coin bank as recited in claim 1, wherein the hole in said top wall is circular so that said top wall forms an inwardly facing annular flange about said circular hole, said lower part is made of a flexible, resilient material, and said reduced bottom portion has a tapered side surface which has an upper end which is slightly larger in diameter than said hole and a lower end which is slightly smaller in diameter than said hole, and an annular groove between said lower edge and said tapered side surface, said groove having a bottom surface which has substantially the same diameter as said hole so that said flange extends into said groove.

4. A coin bank as recited in claim 1, wherein said lower part has a side wall which extends from said top wall to said cylindrical lower end, said side wall having an outer surface which has a circular lower edge, and wherein said base portion has a cylindrical side wall which has a cylindrical outer surface, said circular lower edge and the cylindrical outer surface of said base portion having the same diameter as the circular outer surface of said intermediate portion.

5. A coin bank as recited in claim 1, wherein said coin slot is in said lower part above said lower end.

* * * * *